US005216956A

United States Patent [19]

Adams, Jr.

[11] Patent Number: 5,216,956

[45] Date of Patent: Jun. 8, 1993

[54] TRUCK TRAIN SYSTEM HAVING A REMOVABLE FIRST TRUCK AND A SECOND TRUCK WITH A LOAD PLATFORM AND AN EXTENDABLE CENTER SILL

[76] Inventor: George W. Adams, Jr., 3468 Sandpiper Ct., Hayward, Calif. 94542

[21] Appl. No.: 837,620

[22] Filed: Feb. 18, 1992

Related U.S. Application Data

[63] Continuation of Ser. No. 596,521, Oct. 12, 1990.

[51] Int. Cl.[5] ..... B61F 3/12

[52] U.S. Cl. ..... 105/4.2; 105/159; 105/393; 410/56

[58] Field of Search ..... 105/159, 215.1, 215.2, 105/393, 416, 4.2; 410/52, 53, 56, 57

[56] References Cited

U.S. PATENT DOCUMENTS

| | | | |
|---|---|---|---|
| 2,837,037 | 6/1958 | Holmberg | 105/159 X |
| 2,992,621 | 7/1961 | Schoen | 410/53 X |
| 3,153,489 | 10/1964 | Leavengood et al. | 105/159 X |
| 3,610,168 | 10/1971 | Macomber | 105/159 X |
| 4,179,997 | 12/1979 | Kirwan | 105/159 X |
| 4,386,880 | 6/1983 | Schimmeye | 105/159 X |
| 4,452,147 | 6/1984 | Jwuc | 105/4.2 |
| 4,524,699 | 6/1985 | Pavlick | 105/4.1 |
| 4,559,659 | 12/1985 | Hunter, Jr. | 105/436 X |
| 4,574,707 | 3/1986 | Hickman | 410/53 X |
| 4,636,119 | 1/1987 | Terlecky | 410/54 |
| 4,686,907 | 8/1987 | Woollam et al. | 105/4.1 |
| 4,741,273 | 5/1988 | Sherwood | 105/4.1 |
| 4,751,882 | 6/1988 | Wheatley et al. | 105/4.1 |
| 4,825,778 | 5/1989 | Riley | 105/393 |

*Primary Examiner*—Robert J. Oberleitner
*Assistant Examiner*—S. Joseph Morano
*Attorney, Agent, or Firm*—Schneck & McHugh

[57] ABSTRACT

A truck-train system uses a first ("A") railway dolly or bogie to support the front or fifth-wheel hitch end of roadable truck-trailer. It uses a second ("B") railway dolly to support the rear or roadable wheel end of the same truck-trailer. The first ("A") and second ("B") railway dollies are connected to each other by a longitudinal support member having a telescoping central sill. The central sill is adapted to be detachably connected to the first ("A") railway dolly. The longitudinal support member is connected to the second ("B") railway dolly and also supports a raised platform having a deployable ramp for receiving the wheels of a roadable truck-trailer. The telescoping central sill and longitudinal support member can be locked in any fixed position to take up the train draw-bar tension and to provide for truck-trailers of various lengths.

2 Claims, 6 Drawing Sheets

TRUCK TRAIN SYSTEM HAVING A REMOVABLE FIRST TRUCK AND A SECOND TRUCK WITH A LOAD PLATFORM AND AN EXTENDABLE CENTER SILL

This is a continuation of Ser. No. 596,521, Oct. 12, 1990.

BACKGROUND OF THE PRIOR ART

This invention relates generally to railway truck-train systems and in particular to a truck-train system incorporating a simplified method or loading the truck-trailers onto a railway dolly or bogie.

Truck-train systems of the prior art that used a railway dolly or bogie as the interface between the truck-trailer and the railway system rails generally required special lifting equipment when connecting the truck-trailer to or mounting it on the railway dolly.

One system used a separate incline ramp to roll the trailer, on its wheels, onto one end of a first dolly to which the rear axle of the truck-trailer was attached. The trailer hitch end of the truck-trailer was then attached to a trailer hitch mounted on a pylon on a similar second railway dolly. If a separate incline ramp was not available at the destination, the trailers could not be unloaded.

Another system also mounted the trailer wheels on a railway dolly but connected the front end of the following truck-trailer directly to a special swivel fitting attached to the rear end of the front truck-trailer. A special lifting crane was necessary to mount the truck-trailers on the railway dollies and swivel fittings.

A further truck-train system mounted the truck-trailer wheels on a mechanical platform incorporated into one end of a railway dolly with the trailer hitch end fitted to a trailer hitch attached to a mechanical platform on another railway dolly. The trailer was loaded and unloaded by moving the mechanical platforms laterally onto a paved area next to the railway tracks.

Another truck-train system used a railway bogie incorporating a platform and pivot pin adapted to connect to a truck-trailer. The platform was raised by a pneumatic system to couple it to the underside of the trailer.

Still another truck-train system used a truck-trailer using a standard fifth-wheel truck-trailer hitch at one end and removable rear pneumatic tire wheels at the other end. When used as a railway vehicle, the rear wheels, fitted with pneumatic tires, were removed and replace with the railway dolly fitted with flanged wheels.

Another truck-train railway car was made to be variable in length in order to allow for truck-trailers of various lengths. However, the truck-trailer still required separate cranes or other lifting devices to place it on the railway car.

All truck-train systems of the prior art failed in their efforts by requiring additional equipment for their operation, such as, separate lifting devices at each destination or special mechanical devices incorporated in the railway dolly itself thus increasing the capital cost of the system and requiring continual maintenance.

In addition, the truck-train systems of the prior art did not take into account the need for compatibility between the truck-train system and railway equipment standards and train operating methods that have evolved over the years.

SUMMARY OF THE INVENTION

The truck-train system of the present invention overcomes these problems in that it comprises a first or "A" railway dolly adapted to connect to the front or fifth-wheel trailer hitch end of a roadable truck-trailer. A second or "B" railway dolly is provided to support the rear or roadable wheel end of the truck-trailer. A longitudinal central support member is connected to the second or "B" railway dolly and supports a raised platform and deployable ramp for receiving the rear wheels of the truck-trailer. The longitudinal support member is provided with a telescoping central sill member. The central sill member is detachably connected to the first or "A" railway dolly. The central sill member and longitudinal support member can be locked in a fixed relation to each other.

A truck-trailer is loaded onto the railway car by first disconnecting the central sill from the first or "A" railway dolly and deploying the ramp from the raised platform to receive the wheels of a truck-trailer. The truck-trailer is then backed up the ramp and onto the raised platform and the ramp retracted onto the raised platform.

The first or "A" railway dolly is then backed up to the front or fifth-wheel trailer hitch end of the truck-trailer. Using the ramp built into the railway dolly, the front end of the roadable truck-trailer is raised above ground level so that the fifth-wheel hitch king pin on the front end of the truck-trailer is connected to the fifth-wheel trailer hitch connector on the first or "A" railway dolly.

The telescoping central sill is then extended from the longitudinal support member and connected to the first or "A" railway dolly. The longitudinal support member is then fixedly connecting to the telescoping central sill to take up the draw-bar pull of the assembled train.

It is, therefore, an object of the present invention to provide an improved truck-train system.

It is a further object of the present invention to provide a truck-train system in which loading and unloading truck-trailers can be performed by a standard truck-tractor or railway locomotive.

It is another object of the present invention to provide a truck train system in which separate lifting devices are not used to load and unload the truck-trailers from the railway cars.

It is still a further object of the present invention to provide a truck-train system that interfaces with standard railway equipment.

These and other objects of the present invention will become manifest upon review of the following detailed description when taken together with the drawings.

DESCRIPTION OF THE PREFERRED EMBODIMENT

Figure 2:
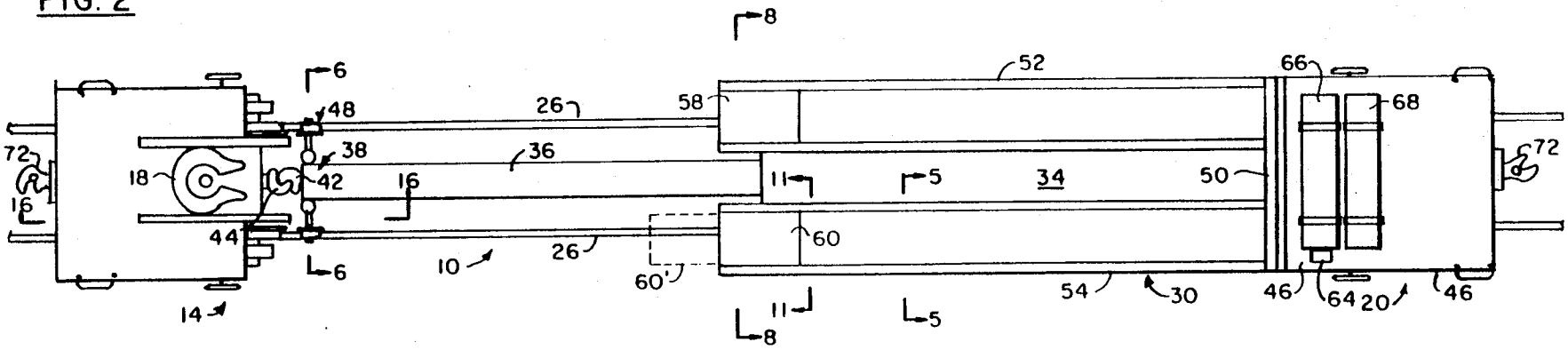
FIG. 2 is top view of the Type "Z-3A" railway car of FIG. 1.
Figure 1:
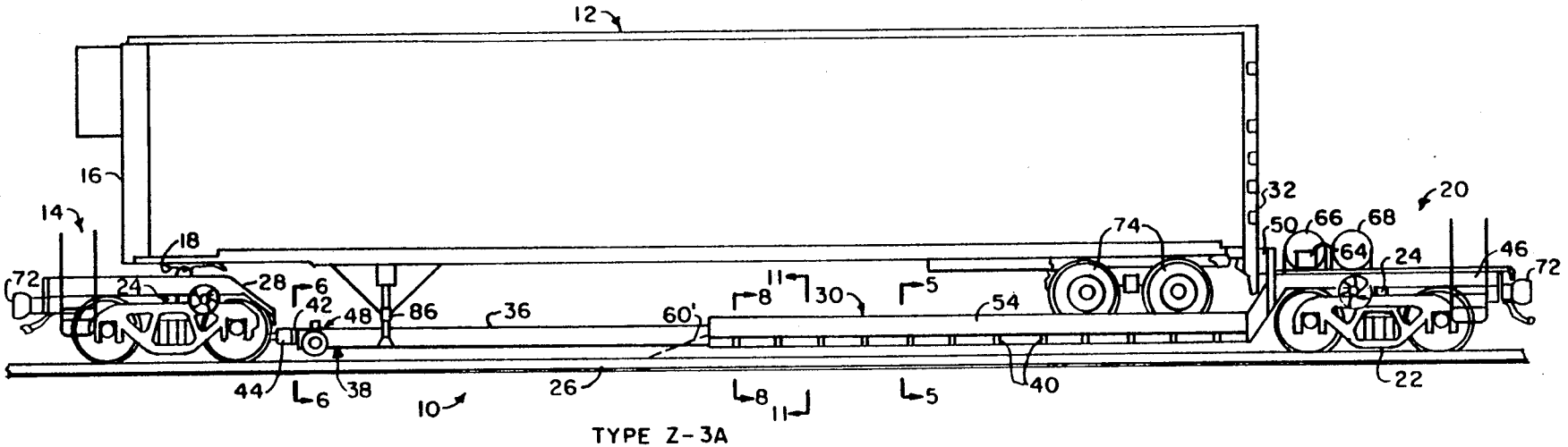
FIG. 1 is a side elevational view of a Type "Z-3A" railway car of the present invention.

With reference to FIGS. 1 and 2, there is illustrated an elevational view of the Z-3A railway car 10 of the present invention loaded with a typical truck-trailer 12 used in the industry. Railway car 10 comprises a first or "A" railway dolly 14 adapted to ride on rails 26 and to receive the front or fifth-wheel trailer hitch end 16 of truck-trailer 12 for connection to fifth-wheel connector 18. Railway car 10 also includes a second or "B" railway dolly 20 comprising a railway truck assembly 22, also adapted to ride on rails 26. Truck assembly 22 is pivotally connected, by pivot 24, to connector platform 46 of main wheel support platform assembly 30.

Main wheel support platform 30 is adapted to receive the rear or roadable wheel end 32 of truck-trailer 12 and comprises a longitudinal support member 34 (FIG. 2) having a central telescoping sill member 36. End 38 of sill member 36 distal railway truck assembly 22 is provided with a coupling member 42 for connection to a like coupling member 44 attached to first or "A" railway dolly 14.

Figure 16:
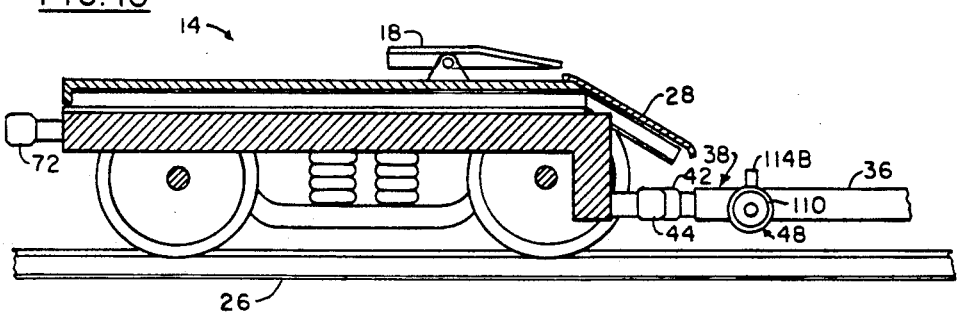
FIG. 16 is an elevational cross-section of "A" railway dolly of FIG. 1 and 2 taken at line 16—16 of FIG. 2.

FIG. 16 is an elevational cross-section of first ("A") railway dolly 14 taken at lies 16—16 of FIG. 2 showing the method of coupling central telescoping sill member 36 to railway dolly 14.

A retractile sill support wheel assembly 48 is connected to end 38 of central sill member 36 to support sill 36 when it is disconnected from first ("A") railway dolly 14.

Returning to FIGS. 1 and 2, main wheel support platform 30 further comprises a pair of truck-trailer wheel support guides or channels 52 and 54. Channels 52 and 54 are attached to longitudinal support member 34 using horizontal support members 40 (FIG. 1).

The ends of wheel guides or channels 52 and 54 distal railway truck assembly 22 are provided with a set of deployable ramps 58 and 60. Ramps 58 and 60 are adapted to receive rear wheels 74 of truck trailer 12 when loading and unloading trailer 12 from main wheel support platform 30.

Main wheel support platform 30 further comprises a connector platform 46, pivotally connected to railway truck assembly 22 by pivot pin 24 (FIG. 1). Connector platform 46 is also attached to one end of longitudinal support member 34 and truck-trailer wheel support guides or channels 52 and 54. An elastomer bumper 50 is also attached to connector platform 46 to act as a stop for rear end 32 of truck-trailer 12.

A pair of compressed air tanks 66 and 68 are mounted on connector platform 46 to provide a compressed air source to deploy and retract central sill member 36 and deployable ramps 58 and 60. A standard railway coupling assembly 72 is provided at the outer ends of "A" railway dolly 14 and railway truck assembly 22 of "B" railway dolly 20. Deployable ramp 60 is shown in its deployed position 60' by dashed lines in FIGS. 1 and 2.

A compressed air control panel 64 is mounted on "B" railway dolly 20 to provide controlled compressed air to retratile sill support wheel assembly 48, sill deployment apparatus 134 and ramp deployment apparatus 160.

Figure 4B:
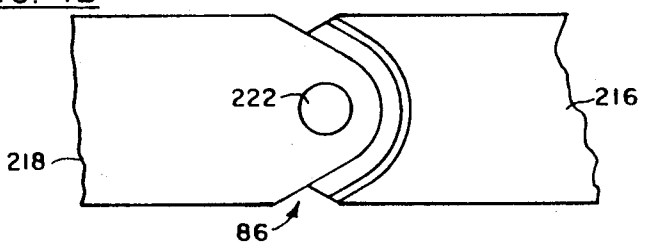
FIG. 4B is a top view of the central portion of the "A" railway dolly of the Type Z-3C railway car of FIG. 3.
Figure 4A:
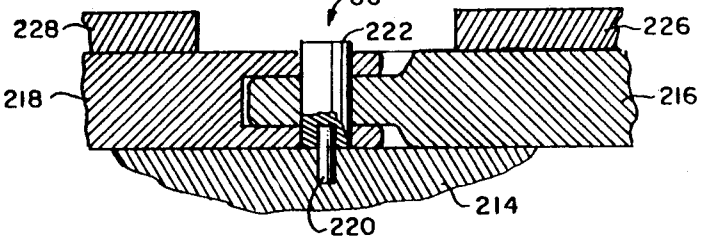
FIG. 4A is an elevational cross-section view of the central portion of the "A" railway dolly of Type Z-3C railway car of FIG. 3.
Figure 4:
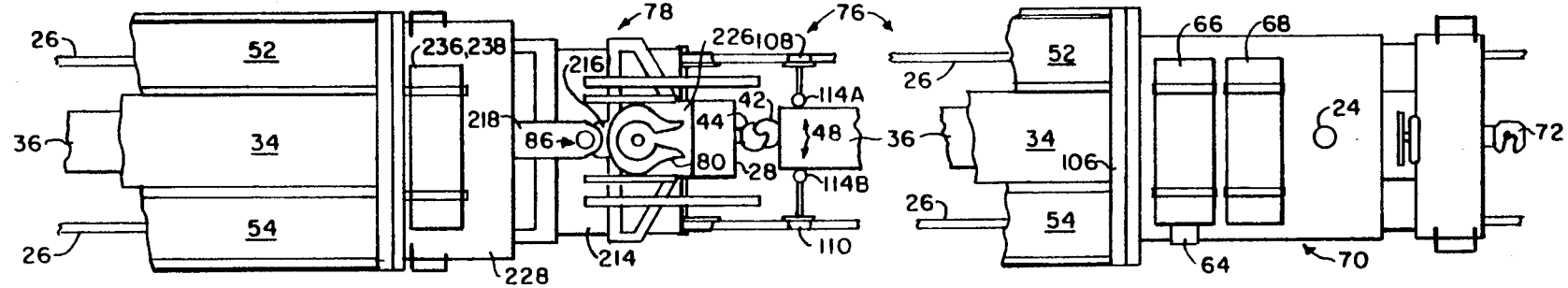
FIG. 4 is a top view of the Type "Z-3C" railway car of FIG. 3.
Figure 3:
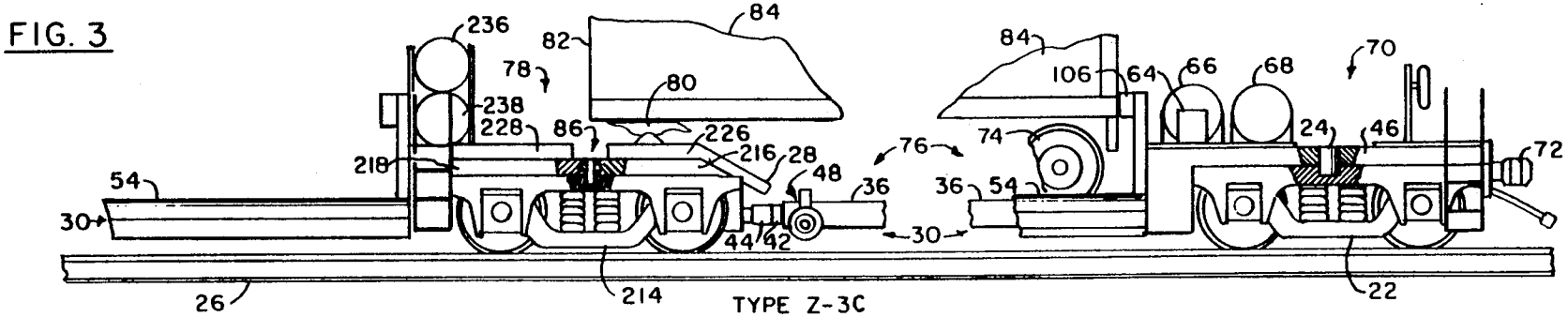
FIG. 3 is a side elevational view of the Type "Z-3C" railway car of the present invention.

With reference to FIGS. 3 and 4, there is illustrated side and top elevational views of Type Z-3C railway car 76. Railway car 76 is similar to Type Z-3A railway car 10 of FIGS. 1 and 2. First or "A" railway dolly 78 of Type Z-3C railway car 76 includes a fifth-wheel connector member 80. Fifth-wheel connector member 80 is identical to fifth-wheel connector member 18. It is adapted to receive and be connected to the front or fifth-wheel connector end 82 of truck-trailer 84 on railway car 76. However, first ("A") railway dolly 78 includes a pivot pin assembly 86 for pivotally connecting railway truck assembly 214 to draw-bar connector members 218 and 216. This allows truck assembly 214 to rotate independently of truck-trailer 84.

First or "A" railway dolly 78 comprises a railway truck 214 pivotally connected to front draw-bar connector member 216 and rear draw-bar connector member 218 by pivot pin 220 (FIG. 4A) of pivot pin assembly 86. Front draw-bar connector member 216 is connected to rear draw-bar connector member 218 by pivot pin 222 (FIG. 4A and 4B) of pivot pin assembly 86. Pivot pins 220 and 222 are attached to each other with their longitudinal axes coincident. Central sill member 36 is connected to front draw-bar connector member 216 by couplers 42 and 44 (FIG. 4).

Truck-trailer support platform 226, on which is mounted fifth-wheel trailer hitch 80, is attached to front draw-bar connector member 216. Platform 228, also attached to main wheel support platform 30, is also attached to rear draw-bar connector member 218.

Thus, it can be seen that pivot pin assembly 86 permits truck 214 to rotate independently relative to front and rear draw-bar connector members 216 and 218, respectively. Concurrently, draw-bar connector members 216 and 218 can also rotate or articulate relative to each other. Thus, pivot pin assembly 86 permits Type Z-3C railway car 76 to articulate about pivot pin 222 when the assembled train negotiates a curve.

Second or "B" railway dolly 70 of Type Z-3C railway car 76 is similar to second or "B" railway dolly 20 of Type Z-3A railway car 10. It also comprises a railway truck assembly 22 attached by pivot pin 24 to main wheel support platform 30. "B" railway dolly 70 also includes a set of compressed air tanks 66 and 68 mounted on connector platform 46.

Also, similar to second or "B" railway dolly 20 of Z-3A railway car 10 of FIG. 1, an elastomer bumper 106 is provided on railway dolly 70. Compressed air control panel 64 is also mounted on Railway dolly 70.

Also, main wheel support platform 30, comprising truck-trailer wheel guide 52 and 54 are attached to connector platform 46 of "B" railway dolly 70. Wheel guides 52 and 54 are adapted to support wheels 74 of truck-trailer 84.

Figure 5:
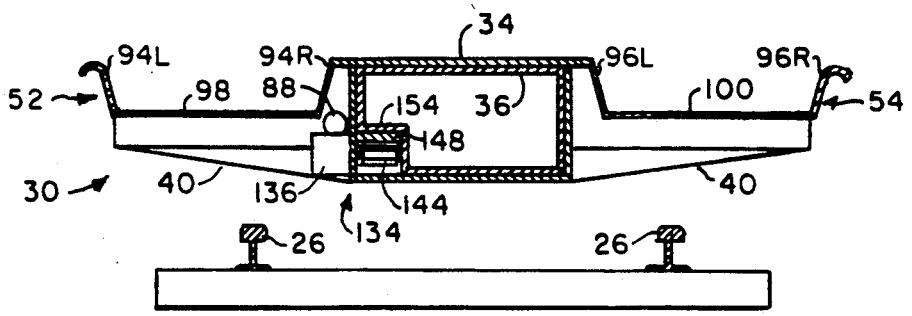
FIG. 5 is an elevational cross-section of the wheel support platform and central sill member taken at lines 5—5 of FIGS. 1 and 2.

With reference to FIG. 5 there is illustrated an elevational cross-section of main wheel support platform 30 taken at lines 5—5 of FIGS. 1 and 2. Main support platform 30 comprises a longitudinal support member 34 containing a telescoping central sill member 36. A compressed air conduit or hose 88 is mounted along the outside of central sill member 36. Compressed air conduit or hose 88 is used to supply compressed air for the railway car braking system (not shown) well known in the art. Telescoping central sill member 36 is adapted to slidably engage the inside surface of longitudinal support member 34. It should have a tight enough fit to allow it to support truck-trailer 12 without appreciable deflection or sagging. It will be appreciated that enough length of central sill member 36 must remain inside longitudinal support member 34 to avoid too great a bending moment on the end of sill member 36 remaining inside longitudinal support member 34.

Main support platform 30 further comprises equally spaced horizontal support members 40 attached to longitudinal support member 34. A pair of truck-trailer wheel support guide channels 52 and 54 are attached to horizontal support members 40. Truck-trailer wheel support guide channels 52 and 54 comprise, respectively, side guides 94R and 94L attached, respectively, to the side edges of wheel support platform 98. Side guides 96R and 96L are attached, respectively, to the side edges of wheel support platform 100.

Figure 6:
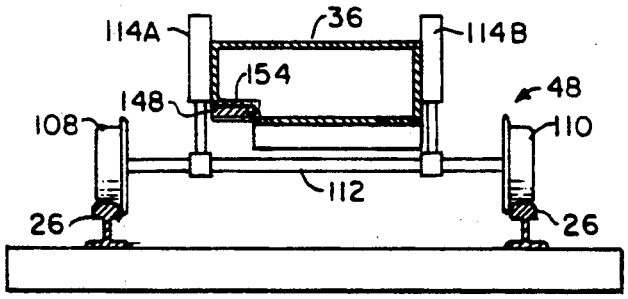
FIG. 6 is an elevational cross-section of the connector end of the central sill member taken at lines 6—6 of FIGS. 1 and 2.

With reference to FIG. 6, there is illustrated an elevational cross-sectional view of retractible sill support wheel assembly 48. Retractible wheel support assembly 48 is used to maintain central sill member 36 in a horizontal position when it is disconnected from "A" railway dolly 14 (or 78). Central sill wheel support assembly 48 comprises a set of flanged railway wheels 108 and 110 journalled to a shaft 112. Shaft 112 is connected to a pair of pneumatic piston and cylinder lifting devices 114A and 114B. Lifting devices 114A and 114B are adapted to raise wheels 108 and 110 above rails 26 when central sill member 36 is connected to "A" railway dollies 14 (or 78).

Figure 7A:
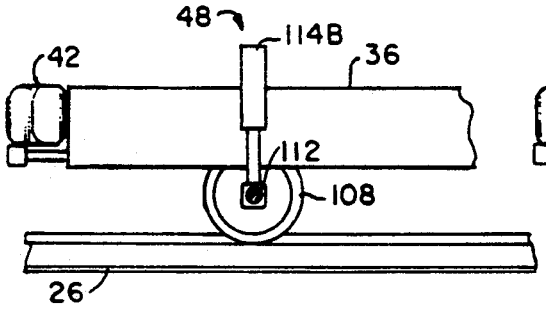
FIG. 7A is a side elevational view of the connector end of the central sill member showing the retractile support wheel configuration in the deployed position.
Figure 7B:
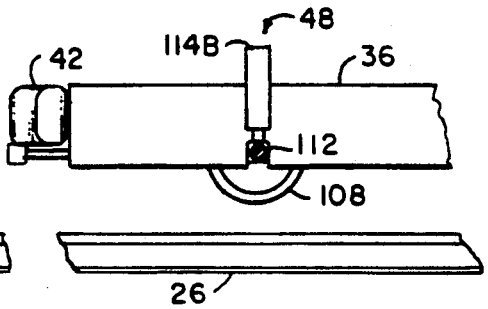
FIG. 7B is a side elevational view of the connector end of the central sill member showing the retractile support wheel configuration in the retracted position.

With reference to FIGS. 7A and 7B, there is illustrated side elevational views of retractile sill support wheel assembly 48, in the raised and lowered positions. These Figures illustrate the manner in which wheels 108 and 110 are retracted after being connected to "A" railway dolly 14 (or 78). In FIG. 7A, pneumatic piston and cylinder lifting devices 114A and 114B are shown in the deployed position with railway wheels 108 and 110, in contact with rails 26. This would be the normal position when central sill member 36 is not connected to "A" railway dolly 14 (or 78). That is, when "B" railway dolly 20 (or 70) is positioned to load or unload a roadable truck-trailer.

With further reference to FIG. 7B, pneumatic piston and cylinder lifting devices 114A and 114B are shown in the raised or retracted position with railway wheels 108 and 110, raise at least 6 inches above rails 26. This would be the normal position when central sill member 36 is connected to "A" railway dolly 14 (or 78). That is, when "A" railway dolly 14 (or 78) is connected to "B" railway dolly 20 (or 70), respectively, and transporting the truck-trailer on the railway car. This would also be the normal position when "B" railway dolly 20 (or 70) is connected to an assembled train for tranfer of the car to another location without a load.

Figure 9:
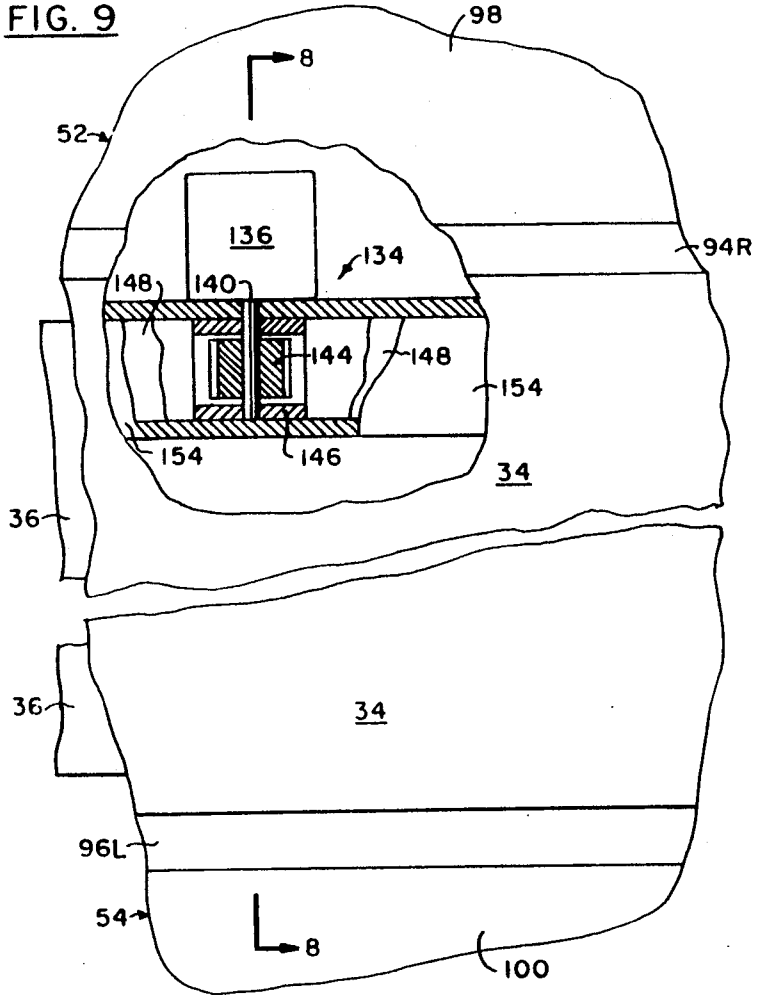
FIG. 9 is a top view and partial section of the longitudinal support member and central sill of FIG. 8.
Figure 8:
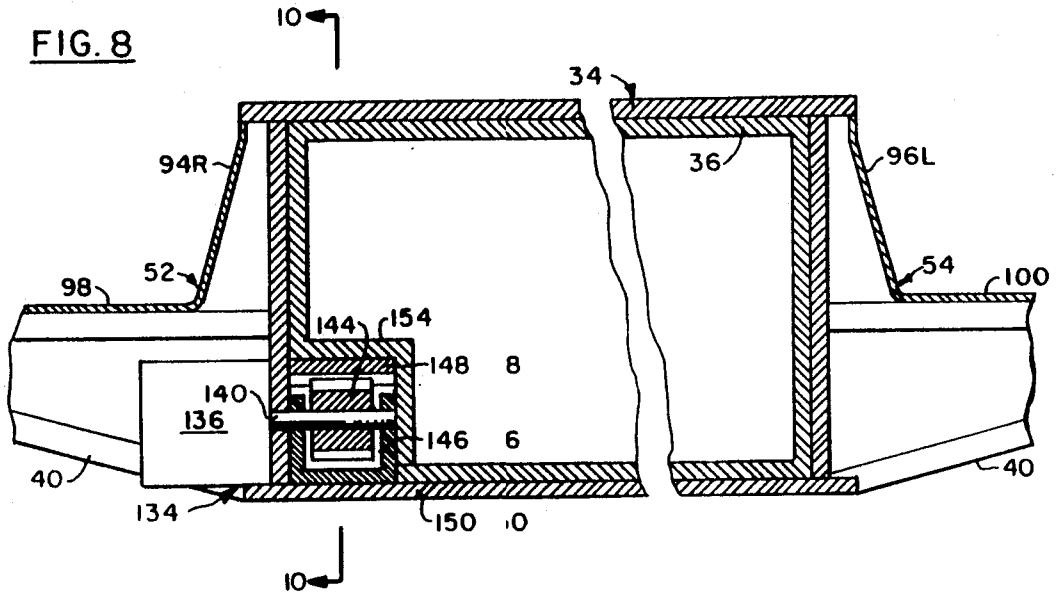
FIG. 8 is an elevational cross-section of the longitudinal support member and central sill taken at lines 8—8 of FIGS. 1 and 2 showing the method of extending and retracting the telescoping central sill member.
Figure 10:
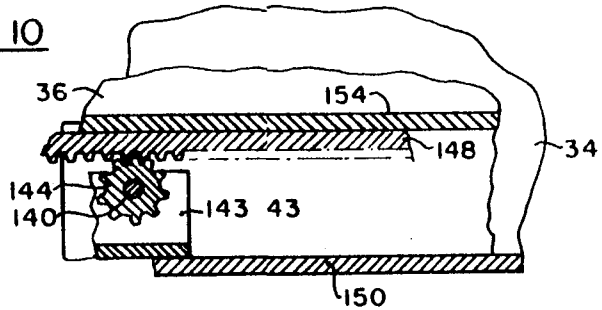
FIG. 10 is a side elevational cross section of the support member and central sill of FIG. 8 taken at lines 10—10 showing the manner in which the pinion gear engages the rack for deployment of the central sill member.

With reference to FIG. 8, there is illustrated an elevational cross-section of sill deployment apparatus 134, taken at lines 8—8 of FIGS. 9. FIG. 9 is a partial cutaway top view of sill deployment apparatus 134 of FIG. 8. FIG. 10 is an elevational cross-section view of compressed air rotary actuator 136 taken at line 10—10 of FIG. 8. FIGS. 8, 9 and 10 illustrate sill deployment apparatus 134 used for deploying or retraction central sill member 36.

Sill deployment apparatus 134 comprises a compressed air rotary motor or actuator 136 mounted on one side of longitudinal support member 34 having a shaft 140 on which is attached pinion gear 144. A support bracket 146 is journalled to shaft 140 and attached to bottom support plate 150 of longitudinal support member 34.

Pinion gear 144 is adapted to engage rack 148 attached to the underside of shelf portion 154 of central sill member 36. It can be seen from FIGS. 8, 9 and 10 that, depending upon the direction of rotation of pinion gear 144, central sill member 36 can be extended or deployed from or retracted into longitudinal support member 34.

Although only one rack and pinion drive is shown, another could be installed on the opposite side of central sill member 36 if faster deployment is required.

Figure 11:
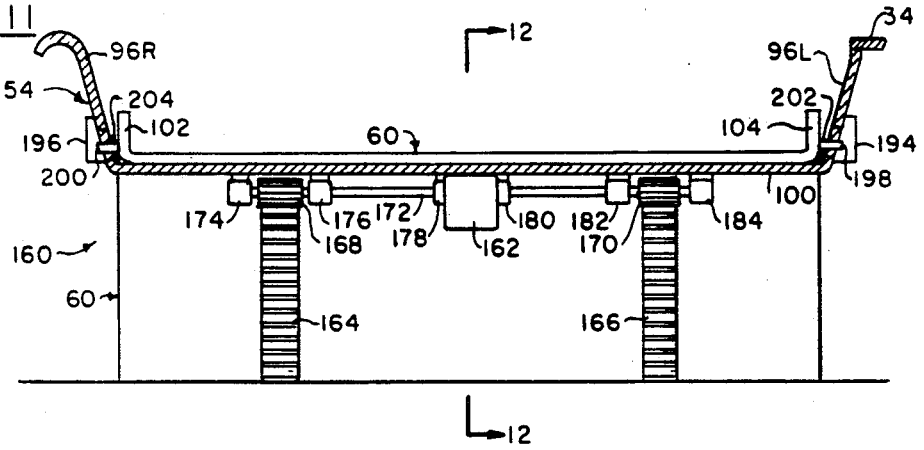
FIG. 11 is an elevational cross-sectional of a truck-trailer wheel support platform showing the apparatus for deploying and retracting the loading ramp taken at lines 11—11 of FIGS. 1 and 2.
Figure 12:
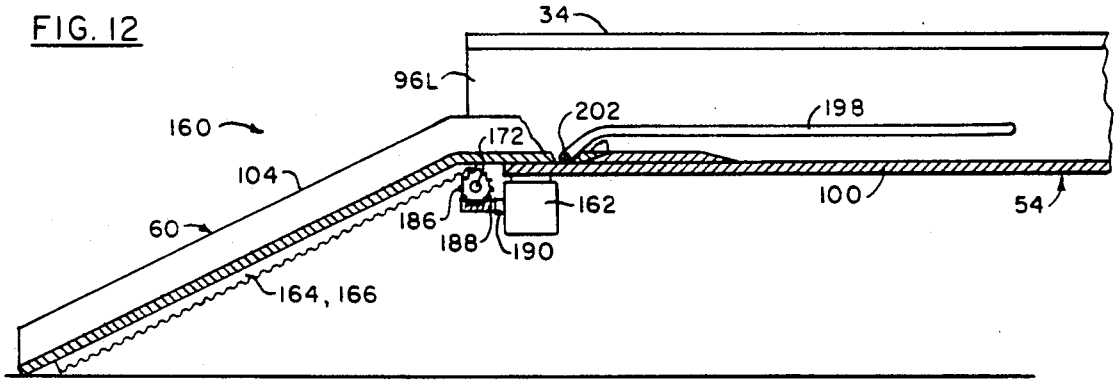
FIG. 12 is a side elevational cross-section view of the loading ramp of FIG. 11 taken at lines 12—12 showing the loading ramp deployed.
Figure 13:
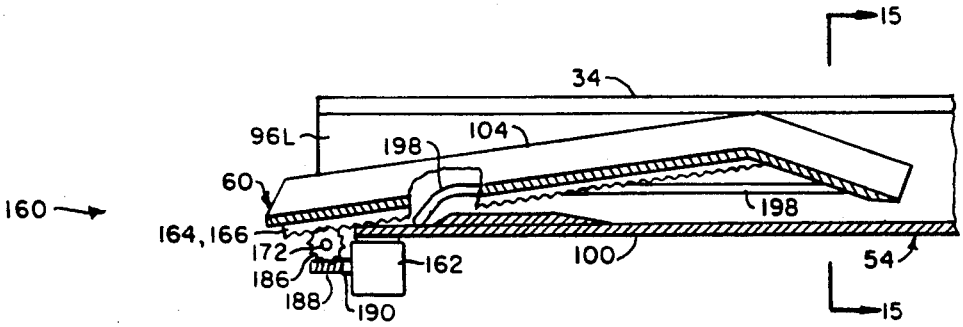
FIG. 13 is a side elevational cross-section view of the loading ramp of FIG. 11 taken at lines 12—12 showing the loading ramp retracted.
Figure 14:
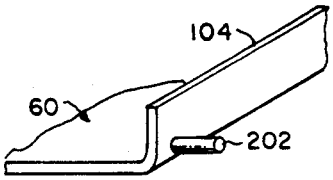
FIG. 14 is an isometric view of the guide pin used on the loading ramp of FIGS. 11, 12 and 13.
Figure 15:
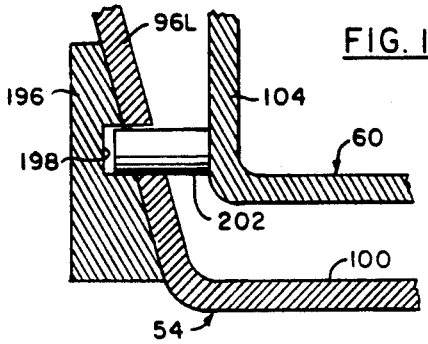
FIG. 15 is a cross-sectional detail of the guide plate and pin guide configuration for the deployable ramp taken at line 15—15 of FIG. 13.

With reference to FIGS. 11 through 15, inclusive, there is illustrated loading ramp deployment apparatus 160 of the present invention FIG. 11 is an elevational cross-section view of loading ramp deployment apparatus 160 taken at lines 11—11 of FIGS. 1 and 2. FIG. 12 is a side elevational cross-section view of loading ramp deployment apparatus 160 showing ramp 60 in the deployed position. FIG. 13 is a side elevational cross-sectional view of loading ramp deployment apparatus 160 showing ramp 60 in the retracted position. FIG. 14 is an isometric view of guide pin 202 used on loading ramp 60 of FIGS. 11 through 13, inclusive. FIG. 15 is an elevational cross-section detail of guide plate 196 and guide pin 202 configuration taken at lines 15—15 of FIG. 13.

Loading and deployment apparatus 160 comprises compressed air rotary motor or actuator 162 mounted proximate the center of wheel support platform 100 on the underside thereof distal "B" railway dolly 20 (or 70), shown in FIGS. 11, 12 and 13. A pair of racks 164 and 166 are mounted on the underside of deployable ramp 60 and are adapted to engage pinion gears 168 and 170, respectively, which are attached to common shaft 172. Common shaft 172 is journalled to pillow blocks 174, 176, 178, 180, 182 and 184 which are also attached to the underside of wheel support platform 100. Proximate the center of common shaft 172 is attached circular gear 186 (FIG. 13) driven by worm gear 188 attached to shaft 190 of compressed air motor or actuator 162.

To control the position of deployable ramp 60 during its deployment and retraction, a pair of guide plates 196 (FIG. 15) and 194 are attached to the outside of each wheel support side member 96L and 96R, respectively, of truck-trailer wheel support guide or channel 54. Guide plates 196 and 194 are provided with grooves or guide slots 198 (FIG. 15) and 200, respectively. Attached to each side of deployable ramp 60 are a pair of guide pins 202 (FIG. 14) and 204. Guide pins 202 and 204 are adapted to slidably engage grooves or guide slots 198 and 200. This will cause the end of ramp 60 engaging wheel support platform 100, when ramp 60 is in the deployed position, to be raised above the level of wheel support platform 100 as it is retracted onto wheel support platform 100.

To operate ramp deployment apparatus 160 and cause deployable ramp 60 in FIG. 12 to be retracted to its position shown in FIG. 13, an operator provides compressed air to compressed air motor or actuator 162. The compressed air will causing actuator shaft 190 to rotate in a direction whereby circular gear 186 will rotate in a clockwise direction. This will cause racks 164 and 166 driven by pinion gears 170 and 172, respectively, to move right (in FIG. 12).

During the first few inches of movement, guide pins 202 and 204 will follow guide slots 198 and 200 to raise the right end of ramp 60 upwardly to clear wheel platform 100. As pinion gears 168 and 170 continue to rotate, racks 164 and 166 and ramp 60 attached thereto will continue to move to the right. Concurrenly, guide slots 198 and 200 in guide plates 194 and 196 will keep the right end of ramp 60 above wheel support platform 100 until ramp 60 is completely retracted. The operator then turns the compressed air supply off until ready to deploy ramp 60 by reversing the above steps.

Truck-trailer wheel support channel guide 52 is provided with a loading ramp deployment apparatus identical to ramp deployment apparatus 160 for wheel support channel guide 54.

Figure 17:
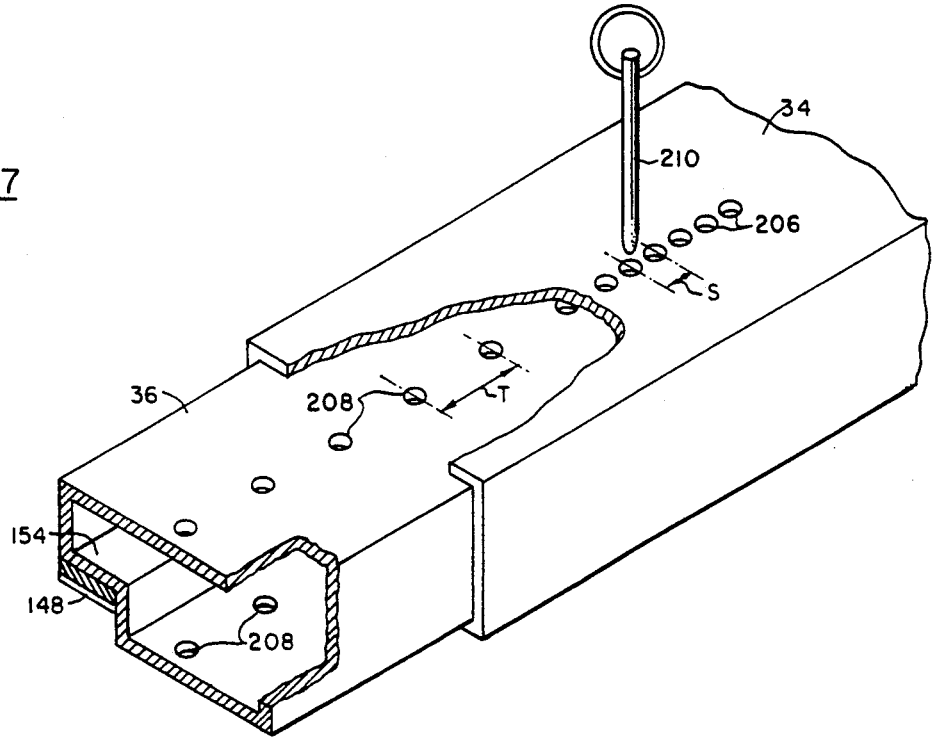
FIG. 17 is an isometric view showing the manner in which the central sill member is connected to the longitudinal support member.

With reference to FIG. 17, there is illustrated the method of locking longitudinal support member 34 to central sill member 36. A series of support member holes 206 are drilled vertically through longitudinal support member 34 equally spaced and a distance "S" between centers. Distance "S" can vary from one to several inches. The total length of the series of holes in longitudinal support member 34 can be one or two feet. A set of sill member holes 208 are drilled through central sill member 36 equally spaced and at a distance "T" on centers for the entire length of central sill member 36.

Distance "T" must not be equal to or an even multiple of distance "S". Both holes 206 and 208 are adapted to receive locking pin 210 which should be large enough to take any shear loads for the draw-bar pull likely to be encountered.

It must be understood that, because of the inequality of the center-to-center spacing of the holes in support member 34 and sill member 36, there will be a vernier type of alignment of the holes 206 and 208. This will permit a finer adjustment of length at which central sill member 36 can be locked in position with longitudinal support member 34 using locking pin 210.

Operation Method

To unload truck-trailer 12 (or 84) from Z-3A (or Z-3C) railway car 10 (or 76) of the present invention, the locomotive engineer stops the train in the loading area. The conductor, using compressed air control panel 64, then lowers retractile sill support wheel assembly 48 and uncouples central sill member 36 from "A" railway dolly 14 (or 78).

The conductor then unlocks central sill member 36 from longitudinal support member 34 by withdrawing sill locking pin 210 from hole 206 and retracts central sill member 36 telescopically into longitudinal support member 34, again using compressed air control panel 64. He then releases the fifth-wheel connector 18 (or 80) from fifth-wheel connector end 16 (or 82) proximate the front end of truck-trailer 12 (or 84).

After releasing fifth-wheel connector 18 (or 80), he then signals the locomotive engineer to pull "A" railway dolly 14 (or 78) forward uncoupling it from fifth-wheel connector 18 (or 80). At the same time, the front end of truck-trailer 12 (or 84) is lowering so that it rests on truck-trailer stanchion support 86 and loading ramps 58 and 60 are deployed.

The locomotive engineer moves forward enough to let the truck-tractor unload the trailer. The truck tractor unit (not shown) backs up to the front end of truck trailer 12 (or 84), lifts it up with the truck's guide ramp 28. The truck tractor continues to back up to cause its fifth-wheel support plate (not shown) to engage the kingpin (not shown) on the truck-trailer. The truck-tractor operator then releases the chain bindings (not shown) used to secure truck-trailer 12 (or 84) to "B" railway dolly 20 (or 70). The truck-tractor operator then pulls truck-trailer 12 (or 78) off main wheel support platform 30.

The rail dolly is loaded by repeating all the above steps in reverse order. For example, as soon as each truck-trailer has been unloaded from "B" railway dolly 20, the driver backs the truck-trailer up and onto wheel guides 52 and 54 of wheel support platform 30 using ramps 58 and 60. The driver then gets out of the truck-tractor cab and goes back to "B" railway dolly 20 wheel support platform 30. He then proceeds to chain (not shown) the rear wheels of the truck-trailer to the platform dolly.

The apparatus for chaining the trailer to wheel support platform 30 merely requires hooks attached to the platform which can engage the links of the chain.

The driver then disconnects the truck-trailer air and electrical lines from the truck-tractor and releases the tractor's fifth-wheel and truck-trailer kingpin. He then drives the tractor from under the trailer to lower it on its stanchions and proceeds to go after another trailer.

The next or second "B" railway dolly 20 is loaded in a similar manner. However, after the second truck-trailer is chained to the second "B" railway dolly 20, the driver releases the air brake on the second "B" railway dolly 20, this time with an "A" railway dolly 14 coupled to it. He then proceeds to back up pushing both "B" railway dolly 20 and "A" railway dolly 14 toward the fifth-wheel end of truck-trailer 12 previously loaded on the first "B" railway dolly. The driver continues to back up until lifting ramp 28 engages front end 16 of the first truck trailer. After reaching the top of lifting ramp 28, the drive continues to back up until fifth-wheel trailer hitch 18 on "A" railway dolly 14 engages the kingpin (not shown) in the trailer, thus locking it in position.

The driver then uses compressed air control panel 64 to retract loading ramps 58 and 60 and deploy central sill member 36 until it can be coupled to "A" railway dolly 14. The driver then connects coupling 42 proximate end 38 of central sill member 36 to coupling 44 of "A" railway dolly 14. He continues to use compressed air control panel 64 to raise support wheels 108 and 100 using pneumatic piston and cylinder lifting devices 114A and 114B. After "A" railway dolly 14 is connected to "B" railway dolly 20, the compressed air lines used for the railway dolly air brakes are then connected The truck driver then disconnects the air and electrical lines from the second trailer and the process is repeated for loading other truck-trailers to form an assembled train.

If the rail dolly is not unloaded and is transported empty, then the conductor retracts ramps 58 and 60. He next signals the locomotive engineer to back "A" railway dolly 14 (or 78) up to "B" railway dolly 20 (or 70). He then recouples the end of center sill member 36 to "A" railway dolly 14 (or 78). Central sill member 36 is then locked to longitudinal support member 34 using pin 210. He then raises support wheels 108 and 110 of sill support wheel assembly 48 and signals the locomotive engineer to proceed.

I claim:

1. A truck-train apparatus comprising a. a truck-trailer comprising
  1. a fifth-wheel connector end,
  2. a rear wheel end, and
  3. a set of roadable wheels connected to said truck-trailer proximate said rear wheel end, b. a first railway dolly, c. a second railway dolly, d. means for connecting said first railway dolly to said second railway dolly comprising
  1. a connector platform,
  2. means for pivotally connecting said connector platform to said second railway dolly,
  3. a main wheel support platform assembly attached at a first end to said connector platform and at a second end to said first railway dolly comprising a) a bumper connected to said connector platform and adapted to engage said rear wheel end of said truck-trailer, b) a longitudinal support member, c) a central sill member having one end adapted to telescopically engage said longitudinal support member, d) means for retracting and deploying said central sill member comprising
  1) a rack attached to said central sill member,
  2) a pinion gear adapted to engage said rack, and
  3) means connected to said longitudinal support member for driving said pinion gear to deploy and retract said central sill member, e) a pair of flanged railway wheels connected proximate the other end of said central sill member, f) means for raising and lowering said flanged railway wheels relative to said other end of said central sill member, g) means for connecting and disconnecting the other end of said central sill member, respectively, to and from said first railway dolly, h) means for connecting said central sill member to said longitudinal support member in a fixed relation thereto, i) means attached to said longitudinal support member for receiving said set of roadable wheels connected to said truck-trailer comprising
  1) a pair of generally parallel disposed truck-trailer wheel support guide channels having a pair of upwardly disposed sill guides and a generally flat wheel support platform adapted to receive said roadable wheels connected to said truck-trailer proximate said rear wheel thereof, and
  2) deployable ramp disposed proximate the end of said truck-trailer wheel support guide channels distal said second railway dolly comprising
  3) means for deploying and retracting said ramp, and e. means connected to said first railway dolly for receiving said fifth-wheel connector end of said truck trailer.

2. A truck-train apparatus comprising a. a truck-trailer comprising
  1. a fifth-wheel connector end,
  2. a rear wheel end, and
  3. a set of roadable wheels connected to said truck-trailer proximate said rear wheel end, b. a first railway dolly, c. a second railway dolly, d. means for connecting said first railway dolly to said second railway dolly comprising
  1. a connector platform,
  2. means for pivotally connecting said connector platform to said second railway dolly,
  3. a main wheel support platform assembly attached at a first end to said connector platform and at a second end to said first railway dolly comprising a) a bumper connected to said connector platform and adapted to engage said rear wheel end of said truck-trailer, b) a longitudinal support member, c) a central sill member having one end adapted to telescopically engage said longitudinal support member, d) means for retracting and deploying said central sill member comprising
  1) a rack attached to said central sill member,
  2) a pinion gear adapted to engage said rack, and 3) a central sill member compressed air motor connected to said longitudinal support member for driving said pinion gear to deploy and retract said central sill member, e) a pair of flanged railway wheels connected proximate the other end of said central sill member, f) means for raising and lowering said flanged railway wheels relative to said other end of said central sill member, g) means for connecting and disconnecting the other end of said central sill member, respectively, to and from said first railway dolly, and h) means for connecting said central sill member to said longitudinal support member in a fixed relation thereto, i) means attached to said longitudinal support member for receiving said set of roadable wheels connected to said truck-trailer comprising 1) a pair of generally parallel disposed truck-trailer wheel support guide channels having a pair of upwardly disposed sill guides and a generally flat wheel support platform adapted to receive said roadable wheels connected to said truck-trailer proximate said rear wheel thereof, and 2) a deployable ramp disposed proximate the end of said truck-trailer wheel support guide channels distal said second railway dolly comprising (a) a rack attached to the underside of deployable ramp, and (b) a pinion gear adapted to engage said rack, and (c) a deployable ramp compressed air motor connected to said truck-trailer wheel support guide channels for driving said pinion gear to deploy and retract said ramp, e. means connected to said first railway dolly for receiving said fifth-wheel connector end of said truck-trailer, and f. means defining a compressed air tank in fluid communication with said central sill member compressed air motor and said deployable ramp compressed air motor.

* * * * *